US008678796B2

(12) United States Patent
Kimata et al.

(10) Patent No.: US 8,678,796 B2
(45) Date of Patent: Mar. 25, 2014

(54) SCROLL-TYPE COMPRESSOR

(75) Inventors: Yoshiyuki Kimata, Aichi (JP); Hajime Sato, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 876 days.

(21) Appl. No.: 12/746,576

(22) PCT Filed: Jun. 2, 2009

(86) PCT No.: PCT/JP2009/060030
§ 371 (c)(1),
(2), (4) Date: Aug. 16, 2010

(87) PCT Pub. No.: WO2009/150958
PCT Pub. Date: Dec. 17, 2009

(65) Prior Publication Data

US 2010/0303661 A1 Dec. 2, 2010

(30) Foreign Application Priority Data

Jun. 10, 2008 (JP) ..... 2008-151929

(51) Int. Cl.
*F04C 18/04* (2006.01)

(52) U.S. Cl.
USPC ..... 418/55.2; 418/55.4

(58) Field of Classification Search
USPC ..... 418/55.1–55.6
See application file for complete search history.

(56) References Cited

U.S. PATENT DOCUMENTS

| | | | | |
|---|---|---|---|---|
| 7,344,365 | B2 * | 3/2008 | Takeuchi et al. | 418/55.2 |
| 7,950,912 | B2 * | 5/2011 | Sato et al. | 418/55.2 |
| 2010/0092318 | A1 * | 4/2010 | Sato et al. | 418/55.2 |

FOREIGN PATENT DOCUMENTS

| | | | |
|---|---|---|---|
| JP | 2000-329079 | A | 11/2000 |
| JP | 2001-221174 | A | 8/2001 |

(Continued)

OTHER PUBLICATIONS

International Search Report of PCT/JP2009/060030, Mailing Date of Jul. 7, 2009.

(Continued)

*Primary Examiner* — Hoang Nguyen
(74) *Attorney, Agent, or Firm* — Westerman, Hattori, Daniels & Adrian, LLP

(57) ABSTRACT

A scroll-type compressor whose capacity can be easily changed and with which an inconvenience can be prevented is provided. A scroll-type compressor includes a fixed scroll having a first spiral-shaped wall member provided upright on a side surface of a first end plate, and an orbiting scroll having a second spiral-shaped wall member provided upright on a side surface of the second end plate, the orbiting scroll being supported so as to be capable of orbital revolution movement while being prevented from self rotation by meshing the wall members with each other. Wall-member stepped portions having a small height at the center and a large height at the outer side in a direction along the spiral are formed on the upper edges of the first and second wall members. End-plate height-difference portions having a large height at the center and a small height at the outer side in the direction along the spiral are formed on the side surfaces of the first and second end plates, at positions facing the wall-member stepped portions. One of the first and second wall members has a cutout portion formed at the outer end in the direction along the spiral and has a smaller spiral-end angle than the other of the first and second wall members.

3 Claims, 7 Drawing Sheets

(56) References Cited

FOREIGN PATENT DOCUMENTS

| | | | |
|---|---|---|---|
| JP | 2001-263274 | A | 9/2001 |
| JP | 3399797 | B2 | 4/2003 |
| JP | 2004-076652 | A | 3/2004 |
| JP | 2006-342776 | A | 12/2006 |

OTHER PUBLICATIONS

Decision to Grant dated Sep. 17, 2013 in corresponding Japanese Patent Application 2008-151929. Explanation of Relevancy—The Decision to Grant a Patent has been received. (2 pages).

* cited by examiner

SCROLL-TYPE COMPRESSOR

TECHNICAL FIELD

The present invention relates to scroll-type compressors and, more specifically, to scroll-type compressors driven at a predetermined rotational speed.

BACKGROUND ART

In general, scroll-type compressors form a compression chamber for compressing a compressible fluid, such as gas, between a fixed scroll and an orbiting scroll. By causing the orbiting scroll to orbitally move, the volume of the compression chamber is reduced to compress the gas in the compression chamber.

In such scroll-type compressors, in order to change the volume, i.e., the capacity, of the compression chamber at the start of compression, a method in which the heights of spiral-shaped wall members (teeth heights) provided upright on the fixed scroll and the orbiting scroll are changed and a method in which the spiral-end angles of the wall members are changed are known (for example, see Patent Literature 1).

CITATION LIST

Patent Literature

{PTL 1} Japanese Unexamined Patent Application, Publication No. 2001-263274

SUMMARY OF INVENTION

Technical Problem

However, with the method in which the teeth heights of the wall members are changed and the method in which the spiral-end angles of the wall members are changed, a scroll mold for molding fixed scrolls and a scroll mold for molding orbiting scrolls need to be prepared for each different capacity. Thus, there has been a problem in that scroll-type compressors of different capacities cannot be easily produced.

Furthermore, with a method in which only the spiral-end angle of the wall member of the orbiting scroll is changed, a pressure difference is created between the compression chambers formed on the dorsal side and the ventral side of the wall member of the orbiting scroll. A force caused by this pressure difference acts on the orbiting scroll or the like, leading to a problem in that an inconvenience such as fluid leakage from the compression chamber occurs.

The present invention has been made to solve the above-described problems, and an object thereof is to provide a scroll-type compressor whose capacity can be easily changed and with which an inconvenience can be prevented.

Solution to Problem

To achieve the above-described object, the present invention provides the following solutions.

A scroll-type compressor of the present invention includes a fixed scroll having a first spiral-shaped wall member provided upright on a side surface of a first end plate, and an orbiting scroll having a second spiral-shaped wall member provided upright on a side surface of the second end plate, the orbiting scroll being supported so as to be capable of orbital revolution movement while being prevented from self rotation by meshing the wall members with each other. Wall-member stepped portions having a small height at the center and a large height at the outer side in a direction along the spiral are formed on the upper edges of the first and second wall members. End-plate height-difference portions having a large height at the center and a small height at the outer side in the direction along the spiral are formed on the side surfaces of the first and second end plates, at positions facing the wall-member stepped portions. One of the first and second wall members has a cutout portion provided at the outer end in the direction along the spiral and has a smaller spiral-end angle than the other of the first and second wall members.

With the present invention, the compression chamber formed on the ventral side, i.e., at the center of the spiral, of the wall member having the cutout portion, among the first and second wall members, has a smaller volume than the compression chamber formed on the dorsal side, i.e., on the outside of the spiral. Because the volume of the compression chamber of the entire scroll-type compressor is the total volume of the compression chambers on the ventral side and dorsal side, the volume is smaller than that of a configuration having no cutout portion.

On the other hand, with the orbital revolution movement of the orbiting scroll, the compression chambers on the ventral side and dorsal side move toward the center of the spiral while being reduced in volume. Then, the compression chambers on the ventral side and dorsal side are brought into communication at the wall-member stepped portions and the end-plate height-difference portions moving toward and away from each other with the orbital revolution movement. That is, the compression chambers on the ventral side and dorsal side are brought into communication when the wall-member stepped portions and the end-plate height-difference portions move away from each other, equalizing the pressures in the two compression chambers. Therefore, the period of time over which the force caused by the pressure difference between the compression chambers on the ventral side and dorsal side acts on the orbiting scroll is short, exerting a limited influence.

In the above-described scroll-type compressor of the present invention, it is preferable that the first end plate of the first wall member have a discharge hole provided near a spiral-start end, through which fluid compressed by a compression chamber formed between the fixed scroll and the orbiting scroll flows out, and the wall-member stepped portions and the end-plate height-difference portions be formed on the outside, in the direction along the spiral, of the outer end of the compression chamber having brought into communication with the discharge hole.

With this configuration, before the compressed fluid flows into the discharge hole, the compression chambers on the ventral side and dorsal side of the wall member having the cutout portion are brought into communication at the wall-member stepped portions and the end-plate height-difference portions. Therefore, the compressed fluid flows out through the discharge hole after the pressures in the two compression chambers are equalized. Thus, the period of time over which the force caused by the pressure difference between the compression chambers on the ventral side and dorsal side acts on the orbiting scroll is assuredly reduced.

In the above-described scroll-type compressor of the present invention, it is preferable that the cutout portion be provided in the second wall member.

With this configuration, by providing the cutout portion in the second wall member, the mass of the orbiting scroll having the second wall member is reduced. This makes it possible to reduce the mass of a balance weight for balancing the orbital revolution of the orbiting scroll. Thus, the mass of the scroll-type compressor can be significantly reduced.

Advantageous Effects of Invention

With the scroll-type compressor of the present invention, the volume of the compression chamber of the entire scroll-type compressor is reduced by providing the cutout portion in one of the first and second wall members. This provides an advantage in that the capacity can be easily changed.

Furthermore, because the compression chambers formed on the ventral side and the dorsal side of the wall member having the cutout portion are brought into communication when the wall-member stepped portions and the end-plate height-difference portions move away from each other with the orbital revolution movement of the orbiting scroll, the pressures in the two compression chambers are equalized, providing an advantage in that an inconvenience such as leakage of fluid in the compression chambers can be prevented.

DESCRIPTION OF EMBODIMENTS

A scroll-type compressor according to an embodiment of the present invention will be described with reference to FIGS. 1 to 12.

Figure 1:
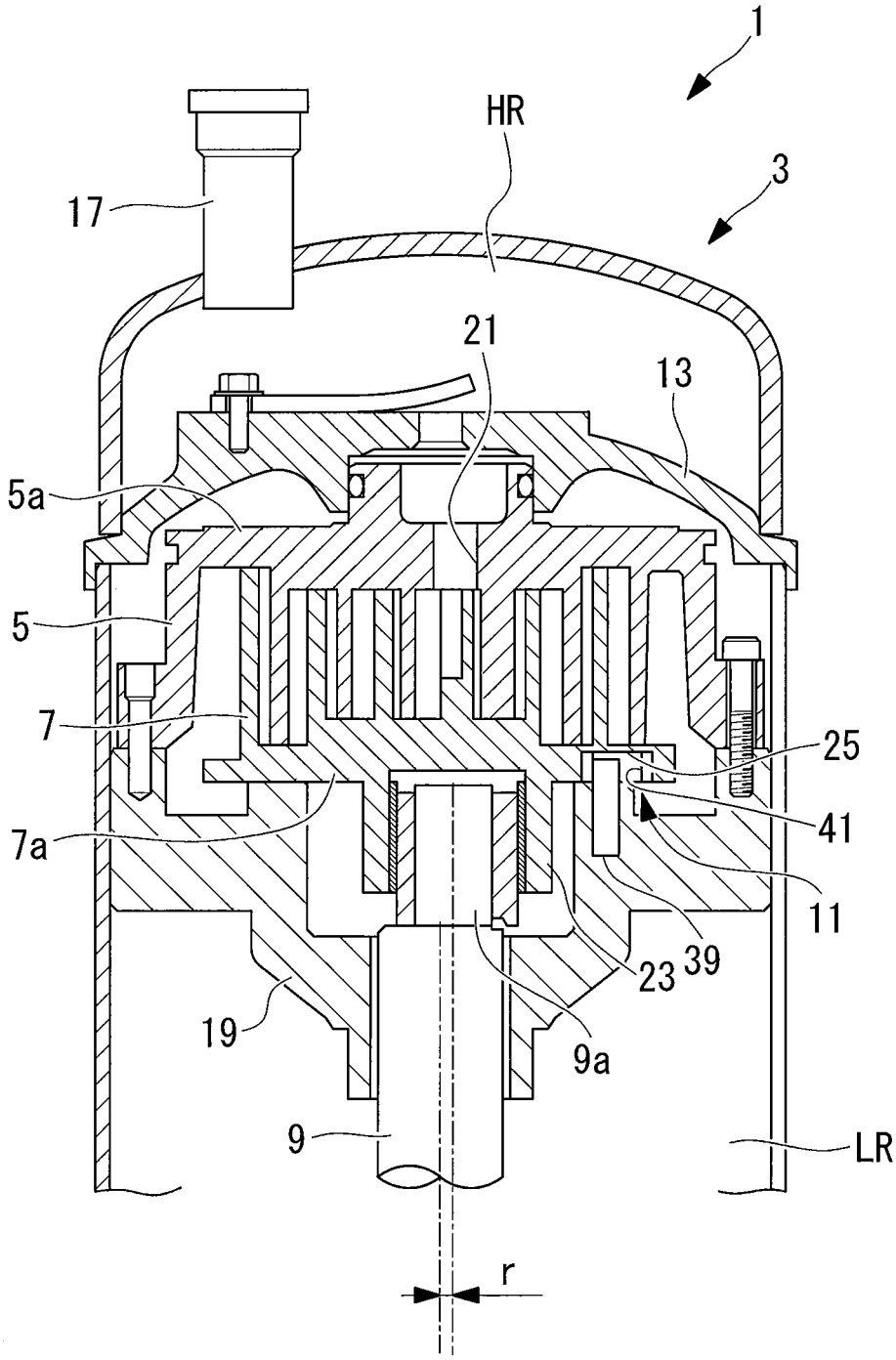
FIG. 1 is a cross-sectional view for describing the configuration of a scroll compressor according to an embodiment of the present invention.

FIG. 1 is a cross-sectional view for describing the configuration of a scroll compressor according to this embodiment.

A scroll-type compressor 1 includes, as shown in FIG. 1, a housing 3, a fixed scroll 5, an orbiting scroll 7, a rotary shaft 9, and a self-rotation preventing portion 11.

As shown in FIG. 1, the housing 3 is a hermetic container in which the fixed scroll 5, the orbiting scroll 7, etc., are disposed.

The housing has a discharge cover 13, an intake tube (not shown), an outlet tube 17, and a frame 19. The discharge cover 13 divides the inside of the housing 3 into a high-pressure chamber HR and a low-pressure chamber LR. The intake tube guides fluid from the outside into the low-pressure chamber LR. The outlet tube 17 guides fluid from the high-pressure chamber HR to the outside. The frame 19 supports the fixed scroll 5 and the orbiting scroll 7.

As shown in FIG. 1, the rotary shaft 9 transmits rotational driving force from a motor (not shown) provided below the housing 3 to the orbiting scroll 7.

The rotary shaft 9 is supported so as to be rotatable in the housing 3 substantially perpendicularly. An eccentric pin 9*a* that causes the orbiting scroll 7 to orbitally revolve is provided on the upper end of the rotary shaft 9.

Figure 2:
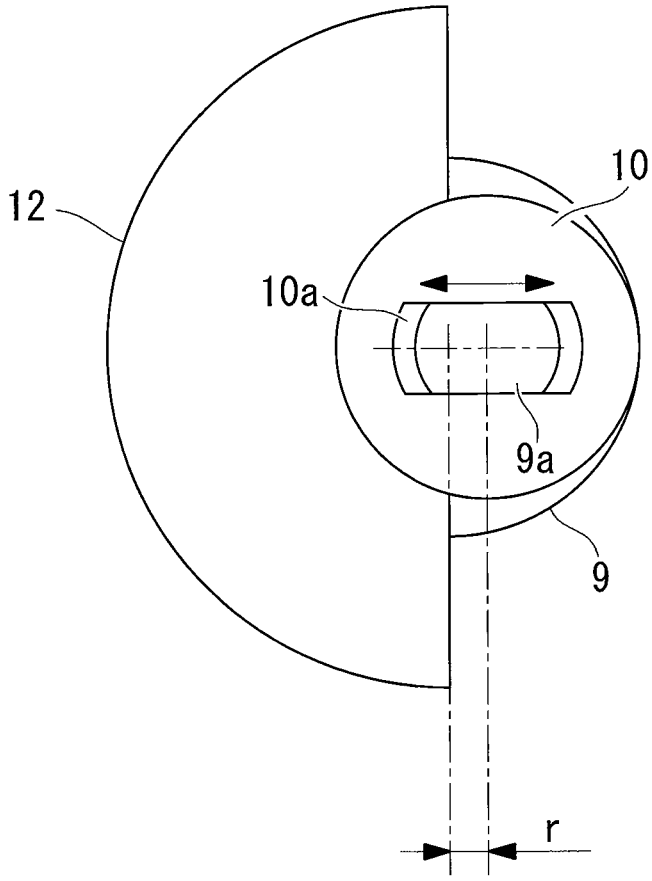
FIG. 2 is a schematic view for describing the configuration of a drive bush and a balance weight disposed between a rotary shaft and an orbiting scroll in FIG. 1.

FIG. 2 is a schematic view for describing the configuration of a drive bush and a balance weight disposed between the rotary shaft and the orbiting scroll in FIG. 1.

As shown in FIGS. 1 and 2, a drive bush 10 and a balance weight 12 are provided between the rotary shaft 9 and the orbiting scroll 7.

The drive bush 10 transmits the rotation transmitted from the rotary shaft 9 and the eccentric pin 9*a* to the orbiting scroll 7. The drive bush 10 is a substantially column-shaped member with the central axis disposed at a position eccentric with respect to the central axis of the rotary shaft 9 by an orbital revolution radius r.

The drive bush 10 has a slide slot 10*a* into which the eccentric pin 9*a* is inserted.

The eccentric pin 9*a* is a substantially cylindrical member extending upward from an end surface of the rotary shaft 9, at a position eccentric with respect to the central axis of the rotary shaft 9 by the orbital revolution radius r of the orbiting scroll 7. Furthermore, a pair of flat portions parallel to the central axis of the rotary shaft 9 are formed on the circumferential surface of the eccentric pin 9*a*.

The slide slot 10*a* is disposed facing the flat portions of the eccentric pin 9*a* and has a pair of flat portions that support the eccentric pin 9*a* in a manner enabling the eccentric pin 9*a* to slide.

As shown in FIG. 1, the fixed scroll 5 and the orbiting scroll 7 compress the fluid flowing into the low-pressure chamber LR of the housing 3 and discharge it to the high-pressure chamber HR.

As shown in FIG. 1, the fixed scroll 5 and the orbiting scroll 7 are disposed so as to be meshed, with the fixed scroll 5 on the upper side and the orbiting scroll 7 on the lower side.

The fixed scroll 5 is fixed to the housing 3 by being fixedly supported by the frame 19. The fixed scroll 5 has a discharge hole 21 for the compressed fluid at the center of the back surface of an end plate 5*a* (the center of the upper surface in FIG. 1).

On the other hand, the orbiting scroll 7 is supported by the frame 19 so as to be capable of orbital revolution movement relative to the fixed scroll 5. The orbiting scroll 7 has a boss 23 provided at the center of the back surface of an end plate 7*a* (the center of the lower surface in FIG. 1) into which the drive bush 10 is inserted. Likewise, a recess 25 in which a ring 41 of the self-rotation preventing portion 11 is disposed is provided in the back surface of the end plate 7*a*, on the circumference of a circle with a predetermined radius from the center of the orbiting scroll 7. The recess 25 is formed to have a substantially circular shape as viewed from the rotary shaft 9 side.

Figure 3:
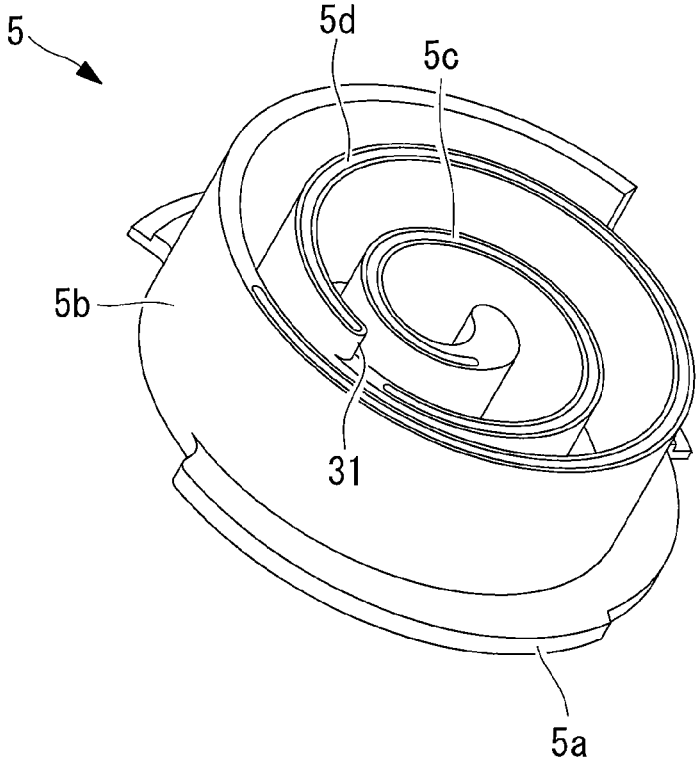
FIG. 3 is a perspective view for describing the configuration of a fixed scroll in FIG. 1.
Figure 4:
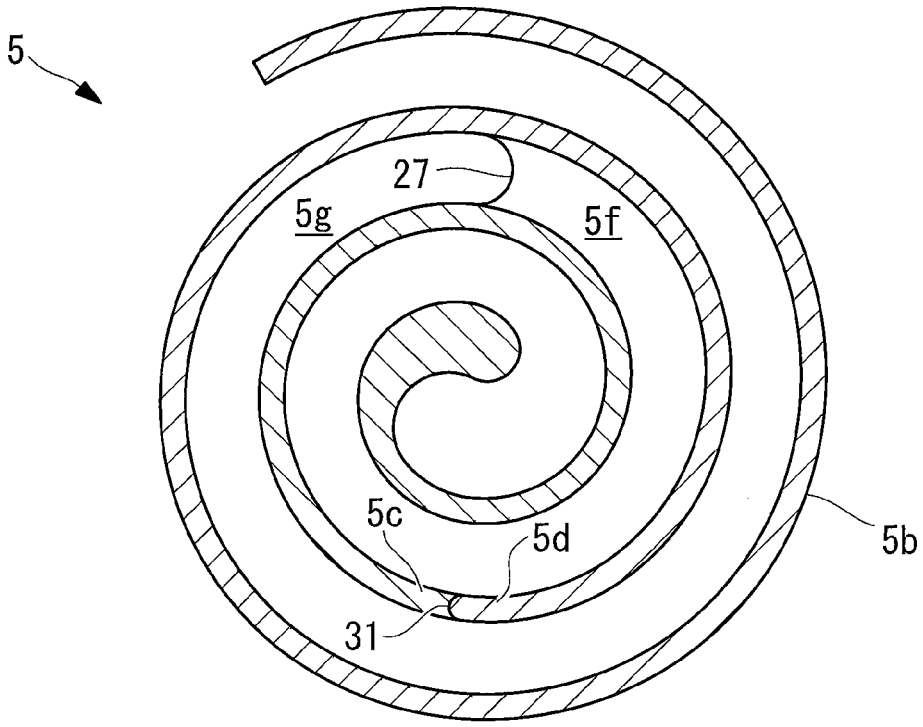
FIG. 4 is a plan view for describing the configuration of the fixed scroll in FIG. 3.

FIG. 3 is a perspective view for describing the configuration of the fixed scroll in FIG. 1. FIG. 4 is a plan view for describing the configuration of the fixed scroll in FIG. 3.

As shown in FIGS. 3 and 4, the fixed scroll 5 has a configuration in which a spiral-shaped wall member (first wall member) 5*b* is provided upright on a side surface of the end plate (first end plate) 5*a*.

Figure 5:
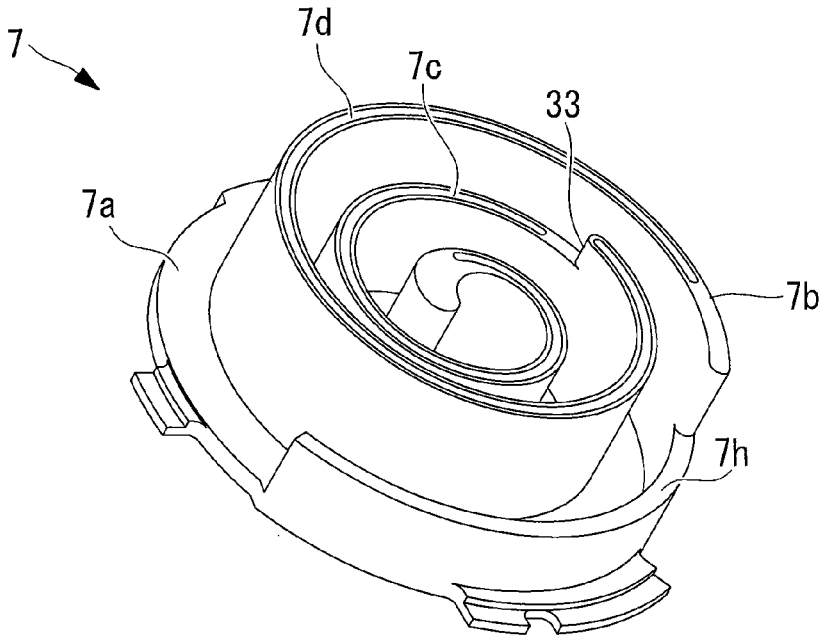
FIG. 5 is a perspective view for describing the configuration of the orbiting scroll in FIG. 1.
Figure 6:
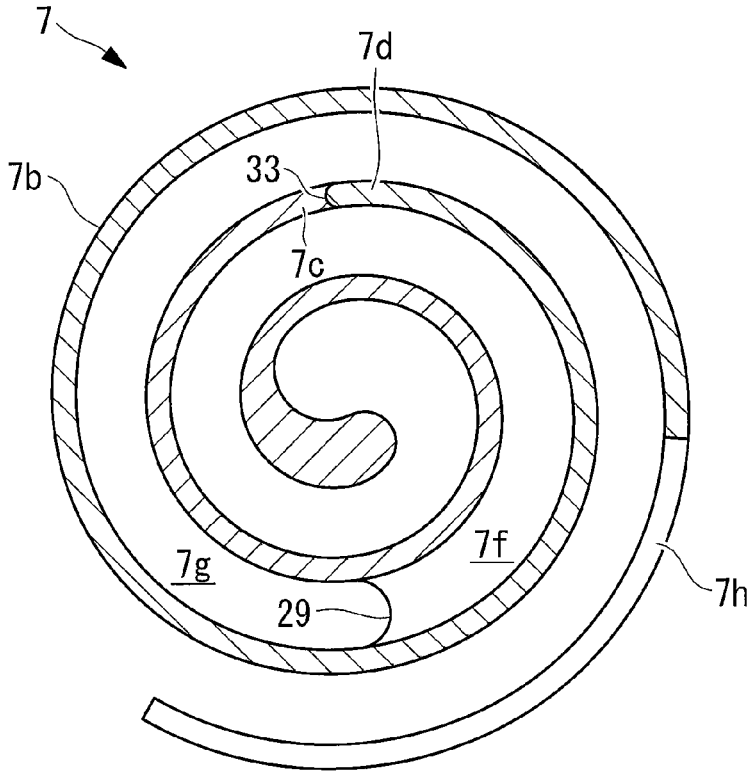
FIG. 6 is a plan view for describing the configuration of the orbiting scroll in FIG. 5.

FIG. 5 is a perspective view for describing the configuration of the orbiting scroll in FIG. 1. FIG. 6 is a plan view for describing the configuration of the orbiting scroll in FIG. 5.

On the other hand, as shown in FIGS. 5 and 6, the orbiting scroll 7 has a configuration in which a spiral-shaped wall member (second wall member) 7*b* is provided upright on a side surface of the end plate (second end plate) 7*a*, similarly to the fixed scroll 5. More specifically, the wall member 7*b* has substantially the same shape as the wall member 5*b* at the fixed scroll 5. The orbiting scroll 7 is disposed eccentrically relative to the fixed scroll 5 by the orbital revolution radius r, such that the phase thereof is shifted by 180 degrees from that of the fixed scroll 5.

Furthermore, a cutout portion 7*h* where the height from the end plate 7*a*, i.e., the tooth height, is partially reduced is provided at a spiral-end portion of the wall member 7*b*. In this embodiment, a description will be given as applied to an example in which the spiral-end portion is moved toward the center by about 80° as viewed from the center of the spiral by providing the cutout portion 7*h*, compared with the wall member 5*b* of the fixed scroll 5.

By providing the cutout portion 7*h* in the wall member 7*b* in this manner, the mass of the orbiting scroll 7 having the wall member 7*b* is reduced. This makes it possible to reduce the mass of the balance weight 12 for balancing the orbital revolution of the orbiting scroll 7. Thus, the mass of the scroll-type compressor 1 can be significantly reduced.

Figure 7:
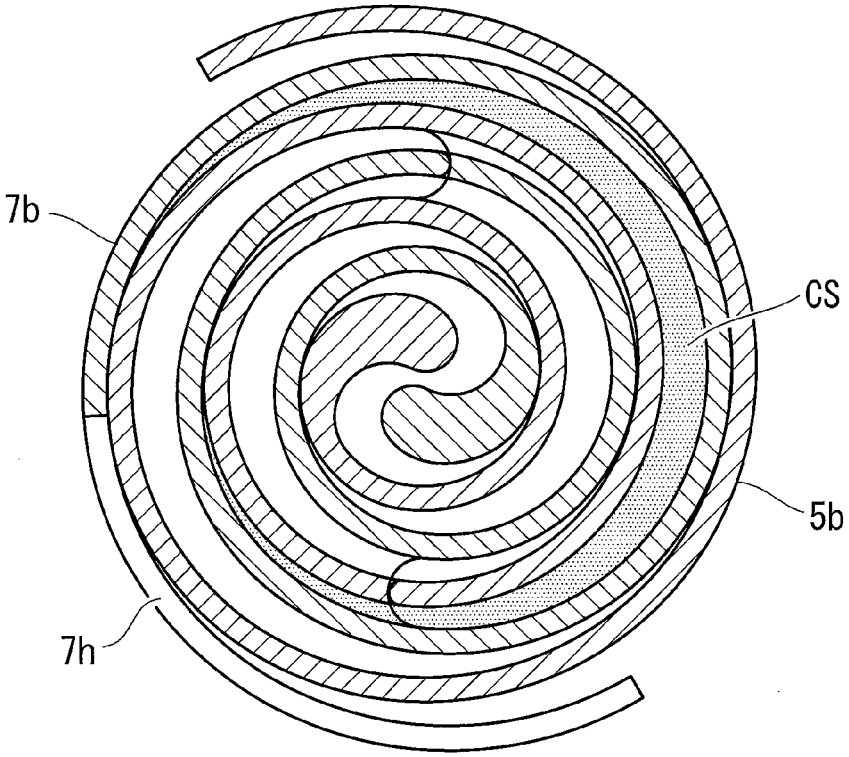
FIG. 7 is a schematic view for describing a state in which the fixed scroll in FIG. 3 and the orbiting scroll in FIG. 5 are meshed.
Figure 8:
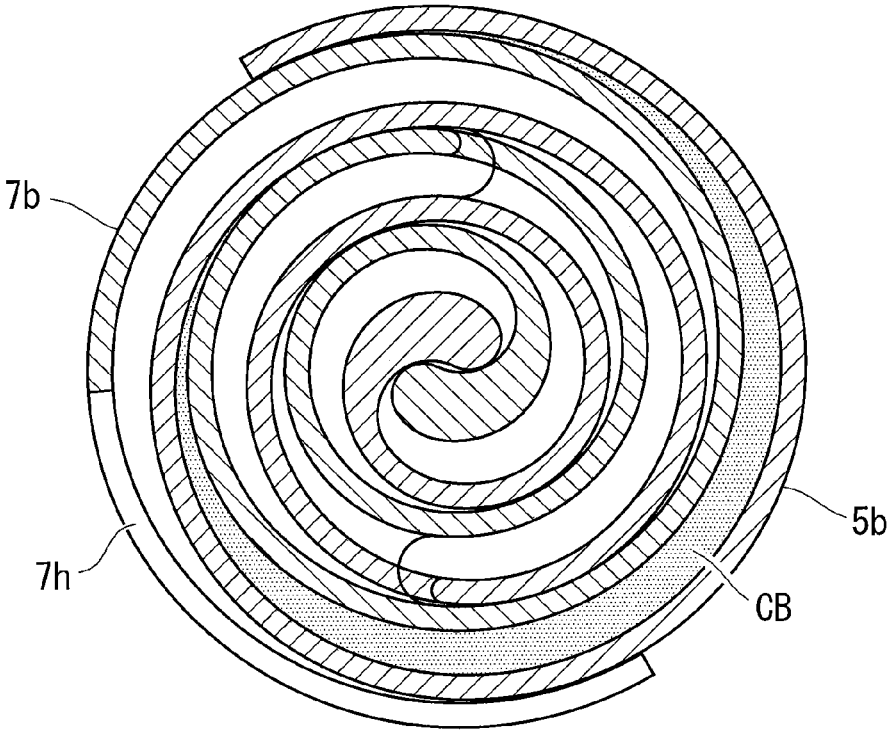
FIG. 8 is a schematic view for describing a state in which the fixed scroll in FIG. 3 and the orbiting scroll in FIG. 5 are meshed.

FIGS. 7 and 8 are schematic views for describing states in which the fixed scroll in FIG. 3 and the orbiting scroll in FIG. 5 are meshed.

As shown in FIGS. 7 and 8, the orbiting scroll 7 and the fixed scroll 5 are assembled such that the wall members 5*b* and 7*b* are meshed with each other, forming compression chambers CB and CS between the wall members 5*b* and 7*b*. In other words, the compression chamber CB is formed at the radially outer side, i.e., on the dorsal side, of the wall member 7*b*, and the compression chamber CS is formed at the radially inner side, i.e., on the ventral side.

FIG. 7 shows a state immediately after the compression chamber CS, having been in communication with the low-pressure chamber LR, is closed. The closing of the compression chamber CS is performed by a spiral-end end of the wall member 7*b* touching the wall member 5*b*, and the compression chamber CS is formed between the ventral side surface of the wall member 7*b* and the dorsal side surface of the wall member 5*b*.

FIG. 8 shows a state immediately after the compression chamber CB, having been in communication with the low-pressure chamber LR, is closed. The closing of the compression chamber CB is performed by a spiral-end end of the wall member 5*b* touching the wall member 7*b*, and the compression chamber CB is formed between the ventral side surface of the wall member 5*b* and the dorsal side surface of the wall member 7*b*.

Because the wall member 7*b* has the cutout portion 7*h*, the closing of the compression chamber CS occurs after the closing of the compression chamber CB. In other words, the volume of the compression chamber CS immediately after closing is smaller than that of the compression chamber CB immediately after closing.

In this embodiment, a description will be given as applied to a case in which, for example, the volume of the compression chamber CS immediately after closing is about A $cm^3$, the volume of the compression chamber CB immediately after closing is about B $cm^3$, and the volume of the scroll-type compressor 1 is about A+B $cm^3$.

In other words, a description will be given as applied to a case in which the cutout portion 7*h* is provided in the scroll-type compressor having a volume of about 2×B $cm^3$ (the volumes of the compression chambers CB and CS are both about B $cm^3$), so that the volume of the scroll-type compressor is reduced by about (B−A) $cm^3$ and is adjusted to about A+B $cm^3$.

The end plate 5*a* of the fixed scroll 5 has, on a side surface on which the wall member 5*b* is provided upright, a height-difference portion (end-plate height-difference portion) 27 formed to have a large height at the center and a small height at the outer end in the spiral direction of the wall member 5*b*.

On the other hand, similarly to the end plate 5*a* of the fixed scroll 5, the end plate 7*a* at the orbiting scroll 7 also has, on a side surface on which the wall member 7*b* is provided upright, a height-difference portion (end-plate height-difference portion) 29 formed to have a large height at the center and a small height at the outer end in the spiral direction of the wall member 7*b*.

Because the height-difference portion 27 is formed, the bottom surface of the end plate 5*a* is divided into two parts, namely, a bottom surface 5*f* provided at the center where the bottom is shallow and a bottom surface 5*g* provided at the outer end where the bottom is deep. A perpendicularly rising connecting wall constituting the height-difference portion 27 and connecting the bottom surfaces 5*f* and 5*g* is provided between the adjoining bottom surfaces 5*f* and 5*g*.

On the other hand, similarly to the above-described end plate 5*a*, because the height-difference portion 29 is formed, the bottom surface of the end plate 7*a* is also divided into two parts, namely, a bottom surface 7*f* provided at the center where the bottom is shallow and a bottom surface 7*g* provided at the outer end where the bottom is deep. A perpendicularly rising connecting wall constituting the height-difference portion 29 and connecting the bottom surfaces 7*f* and 7*g* is provided between the bottom surfaces 7*f* and 7*g*.

The wall member 5*b* at the fixed scroll 5 has a stepped portion (wall-member stepped portion) 31 corresponding to the height-difference portion 29 of the orbiting scroll 7, which divides the spiral-shaped upper edge into two parts and is low at the center of the spiral and is high at the outer end.

On the other hand, similarly to the wall member 5*b*, the wall member 7*b* of the orbiting scroll 7 also has a stepped portion (wall-member stepped portion) 33 corresponding to the height-difference portion 27 of the fixed scroll 5, which divides the spiral-shaped upper edge into two parts and is low at the center of the spiral and is high at the outer end.

More specifically, the upper edge of the wall member 5*b* is divided into two parts, namely, a low-level upper edge 5*c* provided near the center and a high-level upper edge 5*d* provided near the outer terminal end. A connecting edge perpendicular to the orbit surface is provided between the adjoining upper edges 5*c* and 5*d* so as to connect them.

On the other hand, similarly to the above-described wall member 5*b*, the upper edge of the wall member 7*b* is also divided into two parts, namely, a low-level upper edge 7*c* provided near the center and a high-level upper edge 7*d* provided near the outer terminal end, and a connecting edge perpendicular to the orbit surface is provided between the adjoining upper edges 7*c* and 7*d* so as to connect them.

The connecting edge of the stepped portion 31 has a semicircular shape that is smoothly continuous with both inside and outside surfaces of the wall member 5*b* and has a diameter equal to the thickness of the wall member 5*b*, when the wall member 5*b* is viewed in the direction of the orbiting scroll 7.

On the other hand, similarly to the connecting edge of the stepped portion 31, the connecting edge of the stepped portion 33 also has a semicircular shape that is smoothly continuous with both inside and outside surfaces of the wall member 7*b* and has a diameter equal to the thickness of the wall member 7*b*.

The connecting wall of the height-difference portion 27 has an arch shape that matches with a locus defined by the connecting edge of the stepped portion 33 as the orbiting scroll orbits, when the end plate 5*a* is viewed in the orbital axis direction.

On the other hand, similarly to the connecting wall of the height-difference portion 27, the connecting wall of the height-difference portion 29 also has an arch shape that matches a locus defined by the connecting edge of the stepped portion 31.

Furthermore, the height-difference portions 27 and 29 and the stepped portions 31 and 33 are disposed about 360° outside a discharge starting angle at which the compression chambers CB and CS start communicating with the discharge hole 21. In other words, they are disposed outside the outer ends, in the direction along the spiral, of the compression chambers CB and CS having started communicating with the discharge hole 21.

As shown in FIG. 1, the self-rotation preventing portion 11 prevents the self rotation of the orbiting scroll 7 while allowing the orbital revolution movement of the orbiting scroll 7.

As shown in FIG. 1, the self-rotation preventing portion 11 has a pin 39 disposed in the frame 19 and a ring 41 disposed in the recess 25 in the orbiting scroll 7.

The pin 39 is a column-shaped member embedded in the frame 19 and disposed so as to extend from the frame 19 toward the orbiting scroll 7.

The ring 41 is a cylindrical member disposed in the recess 25 provided in the orbiting scroll 7. The radius of the inner circumferential surface of the ring 41 is defined such that the center of the pin 39 is located away from the center of the ring 41 by the orbital revolution radius r of the orbiting scroll 7, in a state in which the outer circumferential surface of the pin 39 is in contact with the above-described inner circumferential surface.

In this manner, by making the self-rotation preventing portion 11 a pin-ring type self-rotation preventing portion 11 using the pin 39 and the ring 41, the production cost for the scroll-type compressor 1 can be reduced compared with a case where an Oldham's linkage is used as a self-rotation preventing portion.

Next, an outline of the operation of the scroll-type compressor 1 having the above-described configuration will be described.

First, fluid compression by the scroll-type compressor 1 will be described.

As shown in FIG. 1, the rotary shaft 9 of the scroll-type compressor 1 transmits a rotational driving force generated by a motor to the orbiting scroll 7. Because the eccentric pin 9*a* of the rotary shaft 9 and the drive bush 10 are connected to the boss 23 of the orbiting scroll 7 through a bearing so as to be capable of relative rotation, the orbiting scroll 7 is orbitally driven.

The orbiting scroll 7, being prevented from self rotation by the self-rotation preventing portion 11, performs orbital revolution movement while self rotation is restricted.

When the orbiting scroll 7 is orbitally revolved, as shown in FIGS. 7 and 8, the wall member 5*b* of the fixed scroll 5 and the wall member 7*b* of the orbiting scroll 7 come into contact, forming two compression chambers CB and CS.

As described above, because the cutout portion 7*h* is formed, the times when the compression chambers CB and CS are formed, in other words, the times when the closing of the compression chambers CB and CS is performed, are different. Therefore, the volume of the compression chamber CS immediately after the compression chamber is formed is smaller than the volume of the compression chamber CB immediately after closing.

Fluid in the low-pressure chamber LR is taken into the formed compression chambers CB and CS. Note that, at this time, the compression chambers CB and CS are located between the bottom surface 5*g* of the fixed scroll 5 where the bottom is deep and the bottom surface 7*g* of the orbiting scroll 7 where the bottom is deep.

When the orbiting scroll 7 is orbitally driven, the two compression chambers CB and CS move along the spiral-shaped wall members 5*b* and 7*b*, respectively, toward the center. The two compression chambers CB and CS are reduced in volume as they move toward the center, compressing the fluid in the compression chambers CB and CS.

At this time, because the volumes of the compression chambers CB and CS immediately after closing are different, the fluid pressure at the compression chamber CB is higher than that in the compression chamber CS by the volume ratio of CS and CB at the time when the compression chamber CS is closed.

FIGS. 9 to 12 are views for describing the positional relationship between the height-difference portion and the stepped portion in FIGS. 4 and 6.

Here, referring to FIGS. 9 to 12, changes in the positional relationship between the height-difference portion 27 and the stepped portion 33 and between the height-difference portion 29 and the stepped portion 31, when the orbiting scroll 7 is orbitally driven, will be described.

Note that, because a change in the positional relationship between the height-difference portion 27 and the stepped portion 33 is the same as that between the height-difference portion 29 and the stepped portion 31, a change in the positional relationship between the height-difference portion 27 and the stepped portion 33 will be described here, and a description about that between the height-difference portion 29 and the stepped portion 31 will be omitted.

Figure 9:
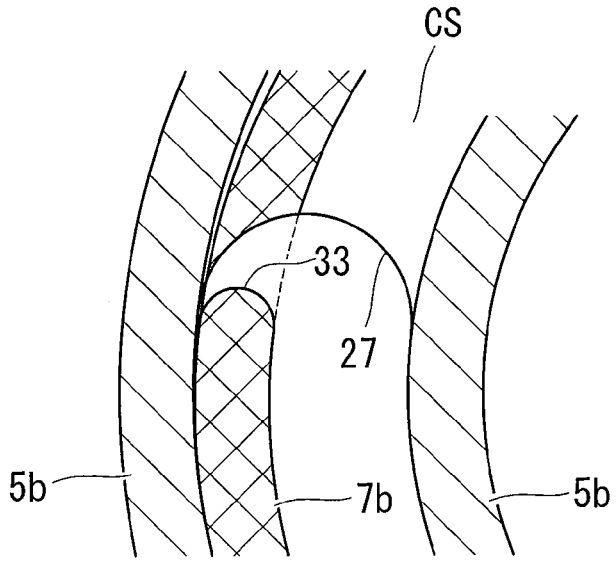
FIG. 9 is a view for describing the positional relationship between a height-difference portion and a stepped portion in FIGS. 4 and 6.

FIG. 9 shows a state immediately before the height-difference portion 27 comes into contact with the stepped portion 33. In this state, the wall member 7*b*, at a portion near the stepped portion 33, is in contact with the wall member 5*b* at the radially outer side (on the left side in FIG. 9). Furthermore, the compression chamber CS is formed between the wall member 7*b*, at a portion near the stepped portion 33, and the wall member 5*b* at the radially inner side (on the right side in FIG. 9), in other words, on the ventral side of the wall member 7*b*.

Figure 10:
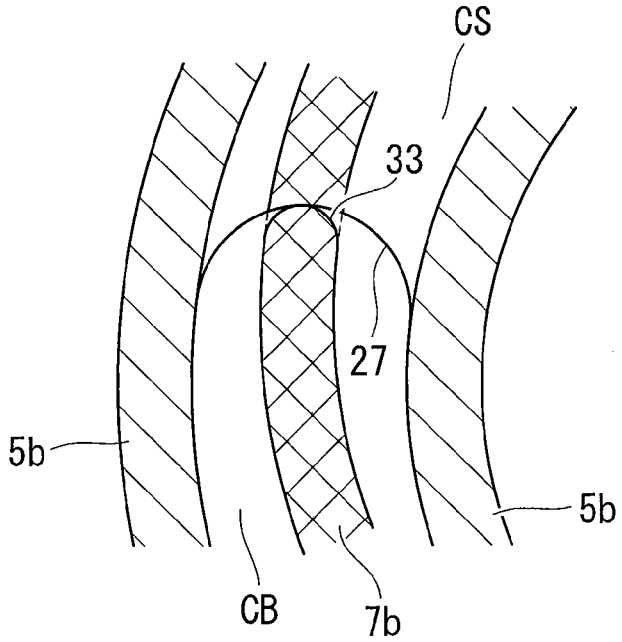
FIG. 10 is a view for describing the positional relationship between the height-difference portion and the stepped portion in FIGS. 4 and 6.
Figure 11:
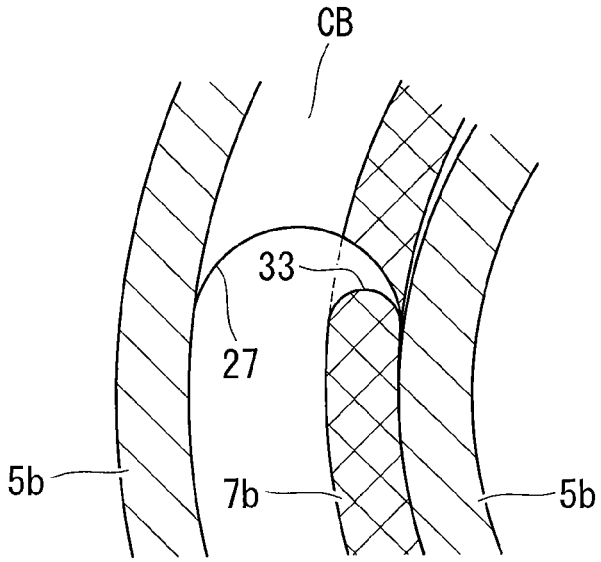
FIG. 11 is a view for describing the positional relationship between the height-difference portion and the stepped portion in FIGS. 4 and 6.

FIG. 10 shows a state in which the orbiting scroll 7 has orbited by about 90° from the state in FIG. 9. The stepped portion 33, being in contact with the height-difference portion 27, has moved to the center of the height-difference portion 27. FIG. 11 shows a state in which the orbiting scroll 7 has further orbited by about 90° from the state in FIG. 10. The stepped portion 33, being in contact with the height-difference portion 27, has moved to the radially inner end of the height-difference portion 27.

The compression chamber CS formed on the ventral side of the wall member 7*b* has moved toward the center (the upper side in FIGS. 10 and 11) in the spiral direction. Furthermore, the compression chamber CB between the wall member 7*b*, at a portion near the stepped portion 33, and the wall member 5*b* at the radially outer side (on the left side in FIGS. 10 and 11), in other words, on the dorsal side of the wall member 7*b*, has moved from the outside (the lower side in FIGS. 10 and 11) toward the center in the spiral direction.

Figure 12:
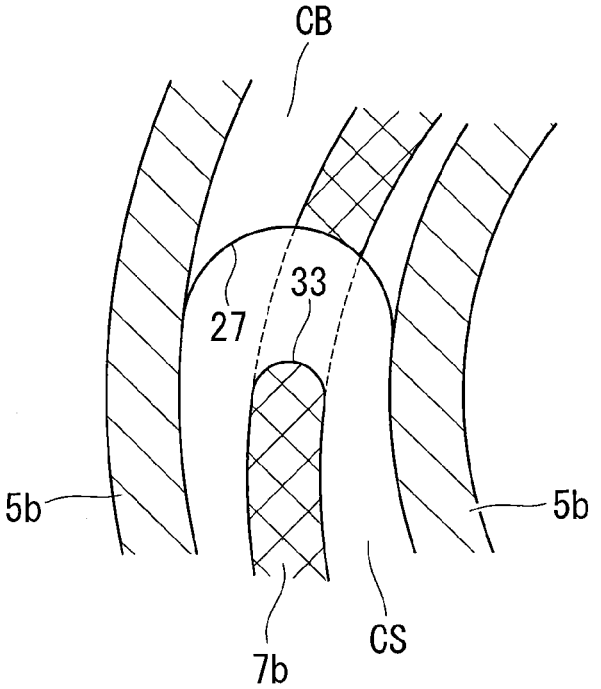
FIG. 12 is a view for describing the positional relationship between the height-difference portion and the stepped portion in FIGS. 4 and 6.

FIG. 12 shows a state in which the orbiting scroll 7 has further orbited by about 90° from the state in FIG. 11. At this time, the stepped portion 33 is separated from the height-difference portion 27 and moves toward the radially outer side (on the left side in FIG. 12).

A gap through which fluid can circulate is formed between the stepped portion 33 and the height-difference portion 27, bringing the compression chamber CB formed on the dorsal side of the wall member 7*b* and the compression chamber CS formed on the ventral side of the wall member 7*b* into communication with each other. The compression chamber CS brought into communication at this time is not the compression chamber CS shown in FIGS. 9 and 10, but a compression chamber CS having moved from outside in the spiral direction.

The fluid circulates through the compression chambers CB and CS, having been brought into communication with each other, due to the pressure difference in the compression chambers. As a result, the fluid pressures in the compression chambers CB and CS are equalized.

Then, when the orbiting scroll 7 is further orbited by about 90° to become the same state as FIG. 9, the compression chambers CB and CS are separated, and the above-described process is repeated again.

The compression chambers CB and CS are located between the bottom surface 5*f* of the fixed scroll 5 where the bottom is shallow and the bottom surface 7*f* of the orbiting scroll 7 where the bottom is shallow, on the center side of the stepped portion 33 and the height-difference portion 27 in the spiral direction. Therefore, the volumes of the compression chambers CB and CS are reduced also in the axial direction of the rotary shaft 9, whereby the inside fluid is compressed with a higher pressure (see FIGS. 1, 4, and 6).

Thereafter, the compression chambers CB and CS move along the spiral-shaped wall members 5*b* and 7*b*, respectively, toward the center as the orbiting scroll 7 orbits. Finally, the discharge hole 21 provided in the center of the fixed scroll 5 is brought into communication with the compression chambers CB and CS, whereby the compressed fluid is discharged toward the high-pressure chamber HR.

On the other hand, when the orbiting scroll 7 is orbitally driven, the orbiting scroll 7 is subjected to a centrifugal force acting in the eccentric direction and a force generated by the pressure of the fluid compressed in the compression chambers CB and CS. The resultant of these forces pushes the orbiting scroll 7 in a direction to increase the orbital revolution radius r.

As shown in FIG. 2, the orbiting scroll 7 is supported by the eccentric pin 9*a* and the slide slot 10*a* in such a manner that the orbital revolution radius r can be changed. Therefore, the orbiting scroll 7 is moved by the above-described resultant force in a direction to increase the orbital revolution radius r, and the wall member 7*b* of the orbiting scroll 7 is urged against the wall member 5*b* of the fixed scroll 5. In other words, the wall member 7*b* and the wall member 5*b* come into tight contact with each other, preventing leakage of fluid in the compression chambers CB and CS.

With the above-described configuration, the compression chamber CS formed on the ventral side of the wall member 7*b* having the cutout portion 7*h*, i.e., at the center of the spiral, has a smaller volume than the compression chamber CB formed on the dorsal side, i.e., at the outer side of the spiral. Therefore, the volume of the compression chamber of the entire scroll-type compressor 1 is the total volume of the compression chamber CS on the ventral side and the compression chamber CB on the dorsal side. That is, because the capacity of the scroll-type compressor 1 can be changed merely by providing the cutout portion 7*h* in the wall member 7*b*, the capacity can be easily changed compared with a method in which the fixed scroll 5 and the orbiting scroll 7 are separately produced.

Furthermore, the compression chamber CS on the ventral side and the compression chamber CB on the dorsal side are brought into communication at the height-difference portion 27 and the stepped portion 33 and at the height-difference portion 29 and the stepped portion 31 when they move toward the center of the spiral with the orbital revolution movement of the orbiting scroll 7 while being reduced in volume. That is, when the wall-member stepped portions and the end-plate height-difference portions move away from each other by the orbital revolution movement of the orbiting scroll 7, the compression chamber CS on the ventral side and the compression chamber CB on the dorsal side are brought into communication. Thus, the pressures in the two compression chambers are equalized.

That is, because the period of time over which the force caused by the pressure difference between the compression chamber CS on the ventral side and the compression chamber CB on the dorsal side acts on the orbiting scroll 7 is reduced, an inconvenience such as leakage of fluid in the compression chamber CS and the compression chamber CB can be prevented.

More specifically, as in the scroll-type compressor 1 of the this embodiment, when the orbiting scroll 7 is supported by the eccentric pin 9*a* and the slide slot 10*a* in such a manner that the orbital revolution radius r can be changed, an inconvenience such as leakage of fluid in the compression chamber CS and the compression chamber CB can be effectively prevented.

On the other hand, because the height-difference portions 27 and 29 and the stepped portions 31 and 33 are disposed about 360° outside the discharge starting angle where the compression chambers CB and CS start communicating with the discharge hole 21, the compression chambers CB and CS are brought into communication at the height-difference portion 27 and the stepped portion 33 and at the height-difference portion 29 and the stepped portion 31, before the compressed fluid flows in the discharge hole 21. Therefore, the period of time from when the pressures in the two compression chambers CB and CS are equalized to when the compressed fluid flows out through the discharge hole 21 and the force caused by the pressure difference between the compression chambers CB and CS acts on the orbiting scroll 7 is assuredly reduced.

Note that the technical scope of the present invention is not limited to the above-described embodiment, but may be variously modified within a scope not departing from the spirit of the present invention.

For example, this embodiment has been described as applied to an example in which the cutout portion 7*h* is provided in the wall member 7*b* of the orbiting scroll 7. However, the cutout portion 7*h* may be provided in the wall member 5*b* of the fixed scroll 5; it is not specifically limited.

REFERENCE SIGNS LIST

1 scroll-type compressor
5 fixed scroll
5*a* end plate (first end plate)

5*b* wall member (first wall member)
7 orbiting scroll
7*a* end plate (second end plate)
7*b* wall member (second wall member)
7*h* cutout portion
21 discharge hole
27 height-difference portion (end-plate height-difference portion)
29 height-difference portion (end-plate height-difference portion)
31 stepped portion (wall-member stepped portion)
33 stepped portion (wall-member stepped portion)
CB, CS compression chamber

The invention claimed is:

1. A scroll-type compressor comprising:

a fixed scroll having a first spiral-shaped wall member provided upright on a side surface of a first end plate; and an orbiting scroll having a second spiral-shaped wall member provided upright on a side surface of the second end plate, the orbiting scroll being supported so as to be capable of orbital revolution movement while being prevented from self rotation by meshing the wall members with each other, wherein wall-member stepped portions having a small height at the center and a large height at the outer side in a direction along the spiral are formed on the upper edges of the first and second wall members, wherein end-plate height-difference portions having a large height at the center and a small height at the outer side in the direction along the spiral are formed on the side surfaces of the first and second end plates, at positions facing the wall-member stepped portions, and wherein one of the first and second wall members has a cutout portion provided at the outer end in the direction along the spiral and has a smaller spiral-end angle than the other of the first and second wall members.

2. The scroll-type compressor according to claim 1, wherein the first end plate of the first wall member has a discharge hole provided near a spiral-start end, through which fluid compressed by a compression chamber formed between the fixed scroll and the orbiting scroll flows out, and wherein the wall-member stepped portions and the end-plate height-difference portions are formed on the outside, in the direction along the spiral, of the outer end of the compression chamber having brought into communication with the discharge hole.

3. The scroll-type compressor according to claim 1, wherein the cutout portion is provided in the second wall member.

* * * * *